US005965312A

United States Patent [19]

Nakazawa et al.

[11] Patent Number: 5,965,312

[45] **Date of Patent: *Oct. 12, 1999**

[54] ONE-COMPONENT DEVELOPER

[75] Inventors: Hiroshi Nakazawa; Koutarou Yoshihara; Etsuo Tominaga; Hiroe Okuyama; Masahiro Uchida; Chiaki Suzuki; Yoshifumi Iida; Toyofumi Inoue; Hiroyoshi Okuno, all of Minami-Ashigara, Japan

[73] Assignee: Fuji Xerox Co., Ltd., Tokyo, Japan

[ * ] Notice: This patent is subject to a terminal disclaimer.

[21] Appl. No.: 08/856,860

[22] Filed: May 15, 1997

[30] Foreign Application Priority Data

May 16, 1996 [JP] Japan ..... 8-121650
Jul. 12, 1996 [JP] Japan ..... 8-183636

[51] Int. Cl.[6] ..... G03G 9/083

[52] U.S. Cl. ..... 430/106.6; 430/110; 430/111; 430/903

[58] Field of Search ..... 430/110, 111, 430/903, 106.6, 120, 126

[56] References Cited

U.S. PATENT DOCUMENTS

| | | | |
|---|---|---|---|
| 4,087,279 | 5/1978 | Sandner | 427/56 |
| 4,461,823 | 7/1984 | Held | 430/120 |
| 5,429,902 | 7/1995 | Saito et al. | 430/110 |
| 5,447,815 | 9/1995 | Kato et al. | 430/110 |
| 5,637,432 | 6/1997 | Okado et al. | 430/110 |
| 5,698,357 | 12/1997 | Inoue et al. | 430/110 |

FOREIGN PATENT DOCUMENTS

| | | |
|---|---|---|
| 46-5782 | 12/1971 | Japan . |
| 48-47346 | 4/1972 | Japan . |
| 48-47345 | 7/1973 | Japan . |
| 58-216252 | 12/1983 | Japan . |
| 59-34539 | 2/1984 | Japan . |
| 59-198470 | 11/1984 | Japan . |
| 59-231550 | 12/1984 | Japan . |
| 60-123862 | 7/1985 | Japan . |
| 60-136755 | 7/1985 | Japan . |
| 60-238847 | 11/1985 | Japan . |
| 64-73354 | 3/1989 | Japan . |
| 1-237561 | 9/1989 | Japan . |
| 2-66564 | 3/1990 | Japan . |
| 2-97967 | 4/1990 | Japan . |
| 4-214568 | 8/1992 | Japan . |
| 5-72797 | 3/1993 | Japan . |
| 5-188633 | 7/1993 | Japan . |
| 5-204183 | 8/1993 | Japan . |
| 6-51561 | 2/1994 | Japan . |
| 6-102699 | 4/1994 | Japan . |
| 6-95429 | 4/1994 | Japan . |
| 6-208242 | 7/1994 | Japan . |
| 6-250442 | 9/1994 | Japan . |
| 6-266156 | 9/1994 | Japan . |
| 8-6286 | 1/1996 | Japan . |
| 8-269359 | 10/1996 | Japan . |

OTHER PUBLICATIONS

*Dictionary of Metal Plating Terms*, Nikkan Kogyo Shimbun, Co., Ltd (Nov. 30, 1994) p. 216 with English–Language Translation of p. 216, lines 6–20.

Diamond, A.S., ed. *Handbook of Imaging Materials*, Marcel Dekker, Inc., NY (1991), pp. 160–161.

Chemical Engineering Articles, vol. 18, No. 3, pp. 303–307, May 1992, Kagaku Kogaku Konbukshu.

*Primary Examiner*—Janis L. Dote
*Attorney, Agent, or Firm*—Oliff & Berridge, PLC

[57] ABSTRACT

A one-component developer comprising an external additive, and toner particles containing a binder resin and a colorant, wherein the external additive contains a titanium compound obtained by the reaction of $TiO(OH)_2$ and a silane compound, and an image forming method using the one-component developer are disclosed. The one-component developer and the image forming method provide excellent flow and a narrow charge distribution, can reduce fluctuation of the charge property due to the environmental change, and can thus form a high-quality image without fogging and the damage to a latent image retainer by filming can be prevented.

10 Claims, 3 Drawing Sheets

ONE-COMPONENT DEVELOPER

BACKGROUND OF THE INVENTION

1. Field of the Invention

The present invention relates to a one-component developer and an image forming method, and more specifically to a developer and an image forming method used in a one-component image forming device where a thin developer layer is formed on a developer holder, the layered developer is conveyed to a developing area, and a latent image on an electrostatic latent image retainer is developed with the developer.

2. Description of the Related Art

Currently, in the field of electrophotography dry developing methods, not only electrostatic process copying machines but also printers, facsimile machines and multifunctional integrated machines which comprise a copying machine, a printer and a facsimile are being used. In particular, a developing method capable of achieving downsizing and light weight of a device, conserving resources, and facilitating recycling is increasingly called for from the ecological point of view. Therefore, in order to meet such needs, an image forming method and a developer used therefor are being improved, or a new image forming method and a developer used therefor are being developed. As electro photography dry developing methods in practical use, two-component developing methods where a toner and a carrier such as iron powder are used, and one-component developing methods where a one-component developer not containing a carrier is used are known.

Two-component developing methods are most widely used. However, these methods have disadvantages such as the deterioration of the developer, inability to maintain image quality over a long period of time due to the adhesion of toner particles onto the carrier surface, and an increase in the size of the developing device due to the need for a toner density control system which can stably maintain toner density in the developer and the need for a mixing device for mixing the developer and the toner newly added thereto. Accordingly, one-component developing methods capable of achieving downsizing and light weight of a developing device without requiring a toner density control system are now becoming the mainstream.

One-component toner developing methods can be classified into magnetic one-component developing methods where a magnetic toner is used and nonmagnetic one-component developing methods where a nonmagnetic toner is used. The magnetic one-component developing method is a method where an electrostatic latent image is developed by holding a magnetic toner on a developer holder with a built-in magnetic field generation means such as a magnet, adjusting the thickness of the magnetic toner layer with an elastic blade formed from silicone rubber, and adhering the toner to a latent image on a latent image retainer. Since the control of toner transport is easy and dirtying of a device such as a copying machine or a printer is minimal, this method currently is in wide practical use. However, because the magnetic toner used in the magnetic one-component developing method contains a black- or brown-colored magnetic substance such as magnetite, the method has the disadvantage of the inability to form full-color images, which is now increasingly required in the market.

On the other hand, a nonmagnetic one-component developing method is a method in which a latent image is developed by supplying a nonmagnetic toner to a developer holder via a toner supply roller and an agitator which are adjacent to the developer holder, adjusting the thickness of the toner layer with a layer regulating blade, and adhering the toner to a latent image on a latent image retainer. Since the toner does not contain a colored magnetic substance, color images can be formed using this method. Further, since the developer holder does not comprise a magnet, the device can be made more light weight and compact and the cost of the device can be reduced, and thus this method is now being applied in compact full-color printers.

Unlike the two-component developing method, the one-component developing method does not comprise a carrier, which is a stable charging and transport means for the toner. Therefore, characteristics required for a toner used in the one-component developing method are more strict than that required for a toner used in the two-component developing method. In particular, in the case of a nonmagnetic one-component developing method, since magnetic force is not utilized for toner layer formation or toner transport, the toner must be held on the developer holder mainly by the force of static electricity. Accordingly, a toner used in the nonmagnetic one-component developing method is required to have a characteristic allowing it to be charged quickly and evenly and a characteristic allowing it to have good flow for stable layer formation. In a case in which these characteristics are not sufficient in the toner, there is a risk of causing image density deterioration, fogging, developing ghosts, dirtying of the device over the long term, and the like.

In addition to these characteristics of developing, other characteristics are required of a toner for achieving a compact light-weight device, improving image quality, and solving ecological problems. For example, a contact-type bias roller is used predominantly for charging a latent image retainer or for transferring the toner in place of a conventional corotron in order to prevent the generation of ozone. Accordingly, high transfer efficiency and good cleaning properties are required for the toner to prevent adhesion to the charging roller. In addition, for preventing dropout caused by a contact-type transfer roller, good adherence and aggregation properties and flow are required.

Conventionally, fine powders of an inorganic oxide are added for stabilizing the charge and transport of the toner by improving the flow and charge property of the toner. Fine silica powders are commonly used as an inorganic oxide because they are characterized by being capable of dramatically improve toner flow. However, since fine silica powders have a strong negative charge, they are not appropriate for a positively charged toner even if they are treated with a compound containing nitrogen for decreasing the negative charge. Further, since silica maintains a strong negative charge in a low-temperature and low-humidity environment and the charge property thereof is lowered in a high-temperature and high-humidity environment due to moisture absorption, thereby the charge property of a toner to which silica is added drastically fluctuates due to environmental change. As a consequence, it is not possible to achieve optimal transporting of the toner onto the developer holder nor an optimal charge property of the toner in both a high-temperature and high-humidity environment and a low-temperature and low-humidity environment, and thus there are problems such as poor image density, background fogging, and dirtying of the device.

In order to solve these problems, a method of treating the surface of inorganic fine powder to be added to a toner is proposed. For example, methods of a hydrophobic surface treatment of fine silica particles are disclosed in Japanese Patent Application Laid-Open (JP-A) Nos. 46-5782, 48-47345, 48-47346, 59-34539, 59-198470, and 59-231550.

However, treated fine inorganic powders are insufficient for preventing fluctuation of the charge property.

Furthermore, as method of decreasing the negative charge of silica, a method of treating the surface of fine silica particles to be added to the toner surface with an amino-modified silicone oil (Japanese Patent Application Laid-Open (JP-A) No. 64-73354), and a method of treating the surface of fine silica particles with amino silane and/or amino-modified silicone oil (Japanese Patent Application Laid-Open (JP-A) No. 1-237561) are known. Such methods of treatment with an amino compound can curb the excessive charge increase of a negatively charged toner in a low-temperature and low-humidity environment, but cannot sufficiently prevent fluctuation of the charge property of fine silica powders due to environmental change.

Furthermore, a toner with silica added in an amount sufficient for providing sufficient flow cannot achieve the rapid charge speed required for a nonmagnetic one-component developer even when the average value of the charge amount of the toner is in a preferable range, because of the high resistance, the high charge property and the low charge speed of fine silica particles. Therefore, toners on a developer holder have a wide charge distribution so that fogging and toner clouding (dirtying of the device) are caused.

As mentioned above, a method involving hydrophobic treatment of silica or a method of decreasing the negative charge cannot sufficiently improve fluctuation of the charge property due to environmental change, a slow charge speed, and a wide charge distribution.

On the other hand, for preventing the dropout caused by a contact-type transfer roller, a method of treating fine silica powders added to the toner surface with a silicone oil is advocated. According to this method, dropout can be prevented but the wide charge distribution of the toner cannot be improved, and thus it is difficult to prevent fogging, toner clouding, and the like.

In order to improve the charge property and the flow of a toner, titania is also commonly used as an inorganic oxide to be added to a toner. Titania has a faster charge speed and low resistance compared to silica, and thus the charge distribution curve of a toner with titania added is sharp. In addition, titania curbs the charge increase of a developer and ghost phenomena. However, titania cannot provide a high charge to a toner, and thus deterioration of the amount of toner transported, deterioration of the density reproduction property caused by the decreased charge, background fogging, and dirtying of the device are easily generated.

For improving the charge property of titania, methods of the hydrophobic treatment of titania added to the toner surface are proposed (Japanese Patent ApplicationLaid-Open (JP-A) Nos. 58-216252, 60-123862, and 60-238847). Hydrophobic titanium oxides can be obtained by treating the surface of titanium oxide with a silane compound, a silane coupling agent, a silicone oil, or the like. With this method, the charge property of the toner can be improved more in a case in which an appropriate type and amount of a processing agent is selected, rather than in a case in which untreated hydrophilic titania is used as the external additive. However, the charge property of a one-component toner cannot be improved to a preferable degree. In addition, as to reducing charge property fluctuation with environmental change, the method has its limitations. In addition, titanium oxide with a process agent added is drastically inferior to a hydrophilic titanium oxide in terms of the charge speed, the sharpness of the charge distribution curve, and the like.

Moreover, titanium oxide is obtained by a sulfuric acid method or a hydrochloric acid method, which is a wet method. In these methods, mainly using an ilmenite ore as the material, titanium oxide is obtained by generating titanium hydroxide from the ilmenite ore and baking the generated titanium hydroxide. However, in a sulfuric acid method or a hydrochloric acid method, aggregated (secondary or tertiary aggregation) particles are generated as a consequence of dehydration condensation, and it is not easy to disperse such aggregated particles again with conventional technology. Therefore, the effect of improving the flow of a toner of titanium oxide obtained in a sulfuric acid method or a hydrochloric acid method is significantly inferior to that of silica. In order to achieve a high image quality, which is increasingly required by the market, attempts have been made to obtain finer toner particles, but by having finer toner particles, the adhering force among particles is strengthened, resulting in further deterioration of the flow of the toner. In the case that titanium oxide produced in a sulfuric acid method or a hydrochloric acid method is used in such toner particles, deterioration of the toner flow is particularly marked. In addition, the specific gravity of titanium oxide conventionally used is higher than that of silica, and thus it has problems such as the inability to be bonded firmly onto the toner surface and the tendency to peel easily away from the toner surface. Accordingly, titanium oxide has a poor long-term charge stability, and, in addition, it can easily cause sleeve dirtying and dirtying of a latent image retainer which results in image quality deterioration and image defects.

Accordingly, in order to achieve both improvement of the flow and prevention of the fluctuation of charge property with environmental change, a method of adding both hydrophobic titanium oxide and hydrophobic silica to a toner is disclosed (Japanese Patent Application Laid-Open (JP-A) No. 60-136755). In this method, it is difficult to uniformly disperse the additives on the toner surface during use, and thus the dispersion state changes due to the stress on the sleeve so that the influence of either the hydrophobic silica or the hydrophobic titanium oxide is easily observable. Therefore, it is difficult to stably cover the shortcomings of both additives over the long term.

Furthermore, in a process of generating titanium oxide in a wet method, a method of hydrolyzing a silane compound in a water-containing media, treating the surface of titanium oxide with the hydrolyzed product of the silane compound, producing titanium oxide particles in a state where aggregation is retarded, and adding particles in a toner is proposed (Japanese Patent Application Laid-Open (JP-A) No. 5-188633). Such treatment with a silane compound improved the toner flow with fewer aggregated particles compared to a conventional hydrophobic treatment method of titanium oxide, but cannot improve the charge property of a negatively charged toner, cannot prevent the fluctuation of the charge property due to environmental change, and exerts and adverse influence in terms of the charge speed (admix property of added toner) and charge distribution.

Furthermore, a method of adding hydrophobic amorphous titanium oxide to a toner is proposed (Japanese Patent Application Laid-Open (JP-A) Nos. 5-204183 and 5-72797). Amorphous titanium oxide can be obtained by hydrolyzing metal alkoxide or metal halide by the CVD method (Chemical Engineering Articles (Vol. 18, No. 3, 303–307 (1992)). Titanium oxide obtained by the hydrolysis method improved the charge property and the toner flow but because it has much adsorbed water within particles, it is liable to remain on the latent image retainer at the time of toner transfer, resulting in dropout on the image or damage on the latent image retainer at the time of cleaning.

In addition, with the toner having an inorganic oxide added to the surface thereof, due to the stress applied to the toner in long-term use, filming or adhesion is generated, the external additive peels off of the toner particles, or the external additive is buried in the toner particles, and thus the toner charge property changes. Accordingly, it is difficult to control the charge and transport of the toner over the long term.

In order to solve these problems, a method of using a specific binder rein for preventing the external additive from being buried is proposed in Japanese Patent Application Laid-Open (JP-A) Nos. 6-95429, 6-102699, and 6-266156. A method of using a specific charge control agent and an external additive is advocated in Japanese Patent Application Laid-Open (JP-A) Nos. 6-51561, 6-208242, and 6-250442. However, neither of these methods can completely solve the above-mentioned problems. In particular, in a full-color developing system, in which control of the amount of toner used in developing a latent image accurately is needed, there are problems still remaining in terms of stabilizing the amount of toner charge and toner transport over the long term.

SUMMARY OF THE INVENTION

An object of the present invention is to provide a one-component developer which has excellent flow, minimal fluctuation of the charge property caused by environmental changes, a narrow charge distribution and which is capable of forming high-quality images without fogging, while preventing the generation of filming, and to provide an image forming method using the one-component developer.

In order to solve the above-mentioned problems, the present inventors undertook extensive study and found that, by using a specific compound as the external additive in a one-component developer comprising an external additive and toner particles containing a binder resin and a colorant, an excellent image can be provided over the long term without generating a density change, fogging, or filming.

That is, a first aspect of the present invention is a one-component developer comprising toner particles containing a binder resin and a colorant, and an external additive, wherein the external additive contains a titanium compound obtained by the reaction of $TiO(OH)_2$ and a silane compound.

The external additive described above may further contain silica treated with a silicone oil or a silicone varnish.

A second aspect of the present invention is an image forming method comprising a step of forming a latent image on a latent image retainer and a step of developing the latent image using a developer on a developer holder, wherein the above-mentioned one-component developer is used as the developer.

DETAILED DESCRIPTION OF THE PREFERRED EMBODIMENTS

Figure 1:
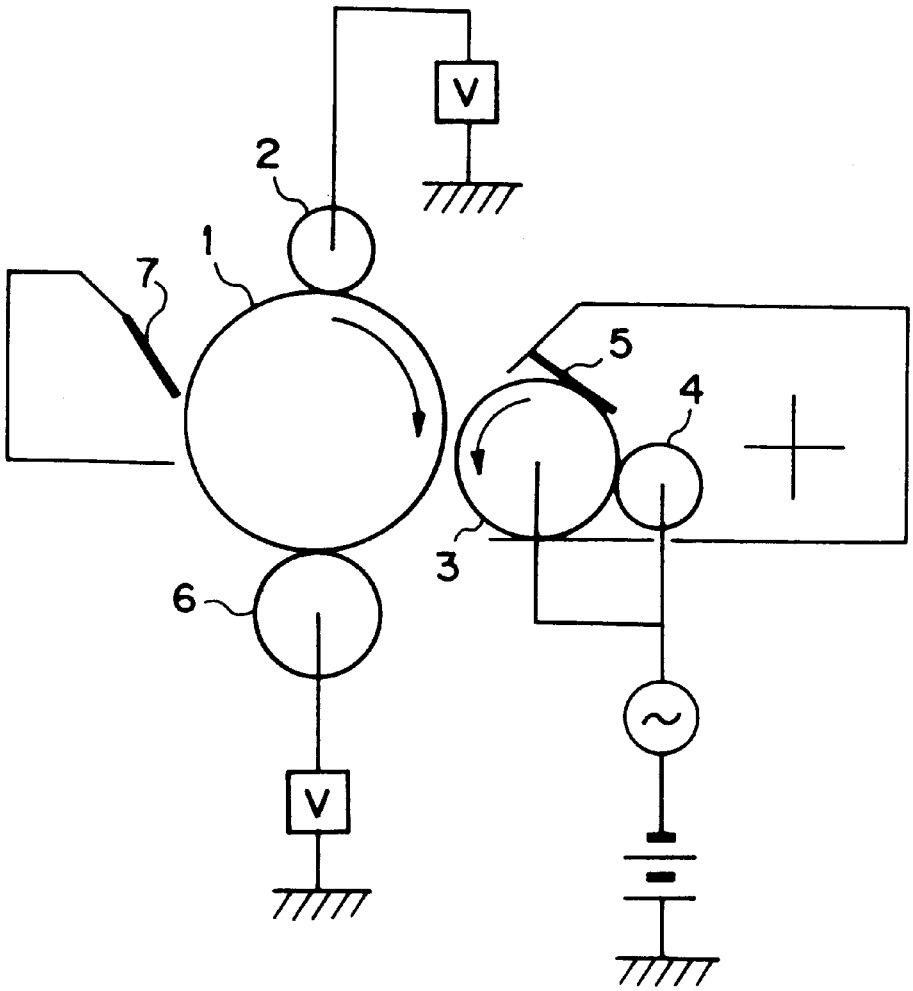
FIG. 1 is a schematic diagram illustrating a preferable embodiment of a one-component developing device applied with the present invention.

A one-component developer of the present invention is a nonmagnetic one-component developer or a magnetic developer, which comprises toner particles containing a binder resin and a colorant, and an external additive, wherein the external additive contains a titanium compound obtained by the reaction of $TiO(OH)_2$ and a silane compound. A one-component developer of the present invention may contain silica treated with a silicone oil or a silicone varnish as an external additive other than the titanium compound. With the use of the silica, a proper flow is provided to the toner, and the adhering force between the toner and a latent image retainer is reduced so that toner transfer is improved to prevent a defective image (dropout).

A specific gravity of a titanium compound used in the present invention is preferably from 2.8 to 3.6. When the specific gravity of the titanium compound is smaller than 2.8, fall-away of the titanium compound from the toner is reduced, but due to increased reaction between processing agents, the processing agents easily peel away from the titanium compound so that a low charge of the toner is easily generated due to filming or sleeve dirtying. On the other hand, when the specific gravity of the titanium compound is more than 3.6, reaction between the processing agents and, therefore, peeling off of the processing agents are prevented, but the titanium compound easily peels away from the toner which makes it easy for the titanium compound to adhere to a developer holder or a latent image retainer.

$TiO(OH)_2$ as a material of a titanium compound used in the present invention is produced using a wet method. Wet methods include both a sulfuric acid method and a hydrochloric acid method.

In a sulfuric acid method, the below-mentioned reaction proceeds in a liquid phase, where insoluble $TiO(OH)_2$ is produced by hydrolysis of $TiOSO_4$.

$$FeTiO_3+2H_2SO_4 \rightarrow FeSO_4+TiOSO_4+2H_2O$$

$$TiOSO_4+2H_2O \rightarrow TiO(OH)_2+H_2SO_4$$

Furthermore, in a hydrochloric acid wet method, titanium tetrachloride is produced by the chlorination of titanium in the same way as in a dry method. Then titanium tetrachloride is dissolved in water, and a strong base is added to the solution, so that $TiOCl_2$ is hydrolyzed to produce $TiO(OH)_2$. The reaction is as follows:

$$TiCl_4+H_2O \rightarrow TiOCl_2+2HCl$$

$$TiOCl_2+2H_2O \rightarrow TiO(OH)_2+2HCl$$

A titanium compound used in the present invention is produced by causing $TiO(OH)_2$ produced by the above-mentioned wet method process to react with a silane compound, and drying the obtained product. With this method, because the obtained titanium compound is not treated with a baking process which is conducted at several hundred degrees, there is no strong bond among the Ti, and consequently particles can be separated out without aggregation as substantially primary particles.

In addition, titanium oxide treated with a conventional method has limitations in terms of the treatment amount with a silane compound. In general, the charge application ability of a silane compound increases as the treatment amount increases, but it saturates when the amount of the silane compound reaches at about 15 to 20% of the amount of the titanium oxide. Therefore, adding a coupling agent to titanium oxide in an amount more than that described above not only does not contribute to high charging but also, due to the reaction among the excessive coupling agent molecules, results in a further increase of aggregated particles than in a case in which aggregated particles are produced only during production. Furthermore, adding a titanium oxide treated as such to a toner results in a lower charge speed and a broader charge distribution. As heretofore mentioned, a conventional titanium oxide contains many aggregated particles, and thus it cannot satisfy any of the requirements of a high charge application ability, a high charge speed, or a narrow charge distribution.

On the other hand, since a titanium compound of the present invention is produced by the direct reaction of $TiO(OH)_2$ and a silane compound, the limit value of the treating amount, which contributes to the improvement of charge ability can be higher. The limit value changes according to the particle size of $TiO(OH)_2$, but can be about three times (about 50 to 70% of the weight of $TiO(OH)_2$) as much as that of a conventional product. Therefore, by controlling the treatment amount of the silane compound, the charge property of the toner can be controlled and the charge ability of the toner can be dramatically improved as compared with a case in which conventional titanium oxide is used. Further, since there is little excess silane compound, there will be little reaction among the molecules of the silane compound, and thus a high charge can be obtained without deteriorating the charge speed or resulting in a broader charge distribution due to an increase in the amount of the silane compound used for treatment.

The resistance of a titanium compound used in the present invention is preferably from $10^8$ to $10^{12}\Omega\cdot$cm for controlling the charge distribution of the toner, preventing fogging, and improving the development property of the toner. A resistance of the titanium compound smaller than $10^8\Omega\cdot$cm drastically reduces the charge property of the toner to generate fogging and toner scattering, whereas a resistance of the titanium compound larger than $10^{12}\Omega\cdot$cm causes a broader charge distribution of the toner, thereby resulting in fogging being generated easily, the formation of two layers in the toner layer on the developer holder due to the high-charged toner, and the formation of development ghosts.

An average primary particle size of the titanium compound used in the present invention i s 100 nm or smaller, preferably 10 nm to 70 nm. When the average primary particle size is smaller than 10 nm, particles are apt to aggregate, so that the dispersion property of toner particles deteriorates. On the other hand, an average primary particle size larger than 100 nm may result in a lower flow of toner.

In the present invention, either of chlorosilane, alkoxysilane, silazane, or a special silylating agent can be used as a silane compound. Examples of chlorosilanes, alkoxysilanes, silazanes, and special silylating agents used in the present invention include, but are not limited to, methyl trichlorosilane, dimethyl dichlorosilane, trimethyl chlorosilane, phenyl trichlorosilane, diphenyl dichlorosilane, tetramethoxy silane, methyl trimethoxy silane, dimethyl dimethoxy silane, phenyl trimethoxy silane, diphenyl dimethoxy silane, tetraethoxy silane, methyl triethoxy silane, dimethyl diethoxy silane, phenyl triethoxy silane, diphenyl diethoxy silane, isobutyl trimethoxy silane, decyl trimethoxy silane, hexamethyl disilazane, N,O-(bistrimethyl silyl)acetamide, N,N-bis(trimethyl silyl)urea, tert-butyl dimethyl chlorosilane, vinyl trichlorosilane, vinyl trimethoxy silane, vinyl triethoxy silane, γ-methacryloxy propyl trimethoxy silane, β-(3,4 epoxy cyclohexyl)ethyl trimethoxysilane, γ-glycidoxypropyl trimethoxysilane, γ-glycidoxypropyl triethoxy silane, γ-glycidoxypropyl methyl diethoxy silane, γ-mercaptopropyl trimethoxy silane, and γ-chloropropyl trimethoxy silane.

The amount of a silane compound used for treatment is, in general, 5 to 80 parts by weight based on 100 parts by weight of $TiO(OH)_2$, and more preferably 10 to 50 parts by weight. With an amount smaller than 5 parts by weight, the characteristics of the silane compound cannot be produced. With an amount larger than 80 parts by weight, the flow of the toner deteriorates due to the excess silane compound. However, since the purposes of the treatment with the above-mentioned silane compounds are to apply a high charge to the toner, to reduce fluctuation of the charge property of the toner with environmental change, to improve the flow of the toner, and to reduce the interaction between the toner and the developer holder, the amount can be properly selected according to the particle size of the toner, the composition of the developer holder, the primary particle size of $TiO(OH)_2$, and the like.

The amount of the above-mentioned titanium compound added to the toner is selected according to the toner particle size, the composition of the developer holder, and the like. In the case that silica treated with a silicone oil or a silicone varnish is not added to the toner, the amount of the above-mentioned titanium compound to be added is, preferably 0.1 to 5.0 parts by weight, more preferably 0.2 to 2.0 parts by weight based on 100 parts by weight of the toner. Furthermore, in the case that silica treated with a silicone oil or a silicone varnish is added to the toner, the amount of the above-mentioned titanium compound to be added is, preferably 0.1 to 3.0 parts by weight, more preferably 0.2 to 2.0 parts by weight based on 100 parts by weight of the toner. With an amount of the above-mentioned titanium compound to be added of less than 0.1 parts by weight, the toner flow cannot be improved. On the other hand, when the amount of the above-mentioned titanium compound to be added is more than 5.0 parts by weight in the case that the above-mentioned silica is not added to the toner, or when the amount of the above-mentioned titanium compound to be added is more than 3.0 parts by weight in the case that the above-mentioned silica is added to the toner, the fixing temperature increases, the fixing strength in the fixing process decreases, and the light transmittance of the toner decreases so that the color of the toner on the lower side can hardly be observed if the one-component developer is used in full color. Particularly in the case of a magnetic one-component developer, the amount of the titanium compound not attached to the toner (free titanium compound) increases so as to dirty the sleeve and adversely affect the toner charge.

In the present invention, silica treated with a silicone oil or a silicone varnish can be used as an external additive along with the above-mentioned titanium compound. silicone oils, represented by the below-mentioned general formula (1) are preferable: General formula (1)

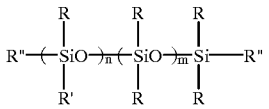

wherein R is an alkyl group having 1 to 3 carbon atoms: R' is selected from the group consisting of an alkyl group, a halogen-substituted alkyl group, a phenyl group and a substituted phenyl group; $R^-$ is an alkyl group having 1 to 3 carbon atoms or an alkoxy group having 1 to 3 carbon atoms; and m and n are an integer.

Examples of silicone oils represented by general formula (1) include dimethyl silicone oil, alkyl-modified silicone oil, α-methyl sulfone-modified silicone oil, chlorophenyl silicone oil, fluorine-modified silicone oil, and amino-modified silicone oil.

Examples of silicone varnishes used in the present invention include a varnish comprising a methyl silicone resin and a varnish comprising methyl phenyl silicone resin.

Moreover, silica treated with such an oil or a varnish may be either a dry silica produced by the vapor-phase oxidization of a halogenated silicon compound or a wet silica produced from water glass.

Conventional technologies such as a method of mixing silica powders and a silicone oil or a silicone varnish using a mixer, a method of spraying a silicone oil to silica powders using a sprayer, and a method of dissolving a silicone oil or a silicone varnish into a solution and mixing the solution with silica powders, can be used as a treatment method with a silica oil or a silicone varnish.

The amount of silicone oil or silicone varnish is preferably from 5 to 30 parts by weight based on 100 parts by weight of silica powders. A BET specific surface area of silica treated with a silicone oil or a silicone varnish is preferably 20 to 300 $m^2/g$, and more preferably 30 to 200 $m^2/g$. When the BET specific surface area of silica is smaller than 20 $m^2/g$, it may be difficult to sufficiently adhere silica to the surface of the toner, and transfer errors (dropout) cannot be prevented sufficiently. On the other hand, when the BET specific surface area of silica is larger than 300 $m^2/g$, silica particles tend to aggregate and it is difficult to disperse silica particles on the toner surface and thus the toner flow tends to be lowered.

Further, an amount of silica treated with a silicone oil or a silicone varnish to be added to the toner is selected according to the toner particle size, the composition of the toner holder, and the like, and is preferably 0.1 to 5.0 parts by weight, more preferably 0.2 to 2.0 parts by weight based on 100 parts by weight of the toner. When the amount of the silica used for treatment is less than 0.1 part by weight, a sufficient flow of the toner cannot be obtained and thus the transfer property of the toner deteriorates and image errors (dropout) occur. On the other hand, when the amount of the silica used for treatment is more than 5.0 parts by weight, fluctuation of the charge property of the toner increases due to environmental change and fluctuation of the image density with environmental change increases and the toner adheres onto members of the developing devices to cause poor charge and image errors. In addition, there is a problem of lower strength or brilliance of the fixed image.

In the case that both the titanium compound and the silica treated with silicone are used, the mixing ratio (parts by weight) of the titanium compound and the silica treated with silicone is 1:0.2 to 1:5, preferably 1:0.3 to 1:3, more preferably 1:0.5 to 1:2. When the amount of the silica treated with silicone is less than 0.2 parts by weight based on 1 part by weight of a titanium compound, the adherence of the toner to the latent image retainer and the toner aggregation property increase to easily generate image errors (dropout). On the other hand, when the amount of the silica treated with silicone is more than 5 parts by weight based on 1 part by weight of a titanium compound, the fluctuation of the charge property of the toner increases due to environmental change and thus the fluctuation of image density due to environmental change is generated to prevent continuously obtaining a preferable image.

A one-componentdeveloper of the present invention includes toner particles in addition to the above-mentioned external additives. Main components of the toner particles are a binder resin and a colorant in the case of a nonmagnetic one-component developer, and a binder resin, a colorant and a magnetic substance in the case of a magnetic one-component developer.

As a binder resin used in the toner particles, conventionally known synthetic or natural resins can be used. Examples of a binder resin include homopolymers or copolymers having monomers of styrenes such as styrene and chlorostyrene; monoolefins such as ethylene, propylene, butylene, and isoprene; vinyl esters such as vinyl acetate, vinyl propionate, vinyl benzoate, and vinyl butyrate; α-methylene aliphatic monocarboxylates such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate; vinyl ethers such as vinyl methyl ether, vinyl ethyl ether, and vinyl butyl ether; and vinyl ketones such as vinyl methyl ketone, vinyl hexyl ketone, and vinyl isopropenyl ketone. Above all, polystyrene, styrene-alkyl acrylate copolymer, styrene-alkyl methacrylate copolymer, styrene-acrylonitrile copolymer, styrene-butadiene copolymer, styrene-maleic anhydride copolymer, polyethylene, and polypropylene can be used as representative binder resins. Furthermore, polyester, polyurethane, epoxy resin, silicone resin, polyamide, modified rosin, and paraffin wax can be used as a binder resin as representative binder resins.

As a colorant contained in toner particles in the present invention, conventional colorants can be used, such as carbon black, aniline blue, carcoyl blue, chrome yellow, ultramarine blue, dupont oil red, quinoline yellow, methylene blue chloride, phthalocyanine blue, copper phthalocyanine, Malachite green oxalate, lamp black, rosebengal, C. I. Pigment Red48:1, C. I. Pigment Red 12:2, C. I. Pigment Red 122, C. I. Pigment Red 57:1, C. I. Pigment Yellow 97, C. I. Pigment Yellow 12, C. I. Pigment Yellow 17, C. I. Pigment Blue 15:1, and C. I. Pigment Blue 15:3.

In the case that one-component developer of the present invention is a magnetic one-component developer, known magnetic substances conventionally commonly used can be used as a magnetic substance contained in the toner particles. Examples of a magnetic substance include metals such as iron, cobalt, and nickel and alloys thereof; metallic oxides such as $Fe_3O_4$, $\gamma$-$Fe_2O_3$ and iron oxide with cobalt added; and ferrites such as Mnzn ferrite and NiZn ferrite. The surface of these magnetic substances may be treated with a coupling agent such as a silane coupling agent and a titanate coupling agent; inorganic fine particles such as silica and alumina; or an organic compound such as a fatty acid compound and resin. The particle size of the magnetic substance is, in general, 0.05 to 0.5 $\mu$m. The shape of the magnetic substance is octahedron, hexahedron, or spherical. Further, the ratio of the magnetic substance contained in the magnetic toner is 30 to 70 weight %, preferably 40 to 60 weight %. A ratio of less than 30 weight % results in a lower image density or fogging in an environment with low temperature and low humidity. On the other hand, a ratio of more than 70 weight % results in a deteriorated toner fixing property.

Furthermore, a charge control agent may be added to a toner in the present invention, if necessary. Examples of charge control agents include conventional ones such as fluorine-containing surface active agents; metal-containing dyes such as salicylic acid metal complex and an azo metal compound; high molecular acids such as a copolymer in which a maleic acid is used as a monomer component; quaternary ammonium salt; azine dyes such as nigrocine, carbon black, and charge-controlling resin. Salicylic acid zinc complex, salicylic acid aluminium complex, and quaternary ammonium salt are particularly preferable among these. The charge control agent is used preferably in the range of 0.1 to 10 parts by weight based on 100 parts by weight of the toner.

A mold-release agent may be added to toner particles so as to improve gloss and offset property. Examples of a mold-release agent include paraffins having 8 or more carbon atoms such as paraffin wax, paraffin latex, and micro crystalline wax; and polyolefins such as polypropylene and polyethylene. These agents can be used alone or in a combination of two or more. The ratio of a mold-release agent is preferably 0.3 to 10% of the weight of toner particles. With a mold-release agent with a ratio of less than 0.3 weight %, the mold-release agent does not function sufficiently at the time of fixing. On the other hand, with a ratio of more than 10 weight %, since an exposure ratio of the mold-release agent on the toner surface increases, toner scattering from the developer holder or image quality deterioration occurs due to poor charging. In addition, since adhering force among toner particles or interaction between the toner and a blade or a developer holder increases, thereby the cleaning property is deteriorated.

The volume average particle size of toner used in the present invention is preferably 3 to 15 $\mu$m, more preferably 5 to 13 $\mu$m, most preferably 5 to 10 $\mu$m. With the volume average particle size of the toner of 3 $\mu$m or smaller, the flow of the toner drastically deteriorates and thus a layer cannot be formed well and cause fogging or dirt. On the other hand, with a volume average particle size of 15 $\mu$m or more, resolution deteriorates and thus a high image quality cannot be achieved. In addition, because the charge amount of the developer per unit weight decreases, a formed layer can hardly be maintained and thus fogging or dirt is easily generated.

A toner used in the present invention can be produced in any known method. Among conventional toner production methods, a kneading/pulverizing method is preferable where a binder resin and a colorant are kneaded while being melted with a kneading device such as a kneader or an extruder, the kneaded composition is cooled, pulverized, and classified so as to produce toner particles, and an additive is added to the toner particles.

In the present invention, the above-mentioned titanium compound and, if any, silica treated with a silicone oil or a silicone varnish are mixed with toner particles. For mixing, conventional mixers such as a V-type blender, Henschel mixer, and Redige mixer can be used. Furthermore, various types of additives may be added to the toner at the time of mixing, if necessary. Examples of additives include other superplasticizers; abrasives such as cerium oxide and magnetite; cleaning auxiliaries such as polystyrene fine particles, polymethyl methacrylate fine particles, and poly(vinylidene fluoride) fine particles; and transfer auxiliaries.

Moreover, in order to prevent poor transfer caused by the increase of adhering force of a toner by a smaller particle size, a large particle size silica or titania used as a second external additive (transfer auxiliary) can be used in a one-component developer of the present invention. With the use of a titanium compound of the present invention with a large particle size titania, a preferable transfer property can be achieved without causing a low charge of the toner caused by the second external additive, an increase of the fluctuation of charge property due to environmental change and lower admix property (a broader charge distribution over the long term), or a lower charge application ability caused by peel-off of a processing agent caused by long-term stress.

In addition, coarse particles of the toner can be removed by the use of a vibrating sieve device or an air sieve device, if necessary.

An image forming method using a one-component developer of the present invention will be explained.

A one-component developer of the present invention is used in, for example, an image forming method comprising a step of forming a latent image on a latent image retainer, a step of forming a toner image on the latent image retainer using the layer of a one-component developer which layer is formed on a developer holder, a step of transferring the toner images on a transfer medium, and a step of fixing the toner images on the transfer medium by heating; and in an image forming device where the image forming method is implemented.

In the latent image forming step, a latent image is formed on a latent image retainer having a photosensitive layer or a dielectric layer by a conventionally known method such as an electrophotography method or an electrostatic recording method. For a photosensitive layer of a latent image retainer used in the present invention, known materials such as organic materials and amorphous silicon can be used. Further, a cylindrical retainer for retaining the photosensitive layer can be obtained in a known method such as a method of extrusion molding of aluminum or an aluminum alloy followed by surface processing.

In the developing step, a thin toner layer is formed with an elastic blade on a rotatable cylindrical member as the developer holder (developing roller) and conveyed to a developing area, and a bias is applied between the latent image retainer, which is arranged so as to contact with the developing roller at the developing area or is arranged so as to be closely-spaced with the developing roller at the developing area and which retains a latent image, and the developing roller so that the latent image is developed with the toner. In the case of a magnetic one-component developer, a rotatable cylindrical member having a built-in magnet is used as the developer holder.

As the developer holder used in the present invention, elastic sleeves formed with silicone rubber; sleeves formed with metals such as aluminum, stainless steel and nickel or ceramics; sleeves whose surface is oxidized for controlling the transport property or charge property of the toner; sleeves which are subjected to a surface treatment such as metal plating, abrasion, and blasting; or sleeves coated with a resin can be used. In the case that a sleeve formed with a metal such as aluminum, stainless steel, and nickel or a ceramic is used as the developer holder, the effects of the present invention are substantially achieved. A toner layer is formed on the developing roller by the contact of an elastic blade with the surface of a sleeve. As materials of elastic blades, rubber elastic bodies such as silicone rubber or urethane rubber are preferably used. In order to control the charge amount of the toner, an organic substance or an inorganic substance may be added and dispersed in the elastic body.

In the transfer step, a toner image on a latent image retainer is transferred to a transfer medium (such as paper). As a transfer method in the present invention, known methods such as a contact-type method where a transfer roller or a transfer belt is contacted with the latent image retainer with pressure and a noncontact-type method using a corotron can be employed. A contact-type method is preferable because it allows downsizing of the device as well as prevents generation of ozone.

In the cleaning step, the toner remaining on the latent image retainer without being transferred in the transfer step is eliminated by a cleaner. As a cleaning means in the present invention, known ones such as a cleaning blade and a cleaning roller are used. As a material of a cleaning blade, elastic rubbers such as silicone rubber and urethane rubber can be used.

In the fixing step, the toner image transferred on the transfer medium is fixed with a fixing device. As a method of fixing, a heat fixing method using a heat roller is commonly used.

EXAMPLES

Hereinafter, the present invention will be explained in further details with reference to embodiments, but the present invention is not limited thereto. In the description below, "part(s)" denotes "part(s) by weight" unless otherwise specified.

$TiO(OH)_2$, a material of a titanium compound, was produced by a wet sedimentation method using an ilmenite ore as the material in which method the ilmenite ore is dissolved in sulfuric acid to separate iron content and the resultant $TiOSO_4$ is hydrolyzed.

The key technology in this preparation is hydrolysis, dispersion adjustment and washing with water, for nucleation. In particular, the pH (neutralization of acid) and the slurry concentration in the dispersion treatment should be accurately controlled since they determine the size of the primary particles of the titanium compound.

In the examples, the charge amount of the toner, the particle size of the toner, and the specific gravity of the titanium compound were measured as mentioned below.

[Charge amount of toner]

The charge amount was measured with a blow-off charge-amount measuring apparatus produced by Toshiba Chemical Corporation after stirring30 g of iron powders of 100 $\mu$m and 1.2 g of the toner with a tubular mixer for 60 seconds at a temperature of 22° C. and a humidity of 55% RH.

[Particle size of toner]

The particle size of the toner was measured with a particle-size measuring apparatus TA-II (aperture diameter 100 $\mu$m) produced by Colter Counter Corp.

[Specific gravity of titanium compound]

The specific gravity of the titanium compound was measured based on JIS-K-0061, 5-2-1, using a Le Chatelier specific-gravity bottle. The operation is as follows:

Approximately 250 ml of water was placed in a Le Chatelier specific-gravity bottle and adjusted so that the meniscus coincided with the calibration. The specific-gravity bottle was soaked in a constant-temperature water tank. When the liquid temperature became 20.0±0.2° C., the position of the meniscus was accurately read based on the calibration of the specific-gravity bottle (with an accuracy of 0.025 ml). Approximately 100 g of the sample was weighed to the digit of 1 mg, and the mass was defined as W. The weighed sample was placed in a specific-gravity bottle and bubbles were removed. The specific-gravity bottle was soaked in a constant temperature water tank. When the liquid temperature became 20.0±0.2° C., the position of the meniscus was accurately read based on the calibration of the specific-gravity bottle (with an accuracy of 0.025 ml).

The specific gravity is calculated as follows:

$D=W/(L_2-L_1)$ $S=D/0.9982$

Herein

D: density of the sample (20° C.) (g/cm$^3$)

S: specific gravity of the sample (20/20° C.)

W: apparent mass of the sample (g)

$L_1$: level of the meniscus before placing the sample in the specific-gravity bottle (20° C.) (ml)

$L_2$: level of the meniscus after placing the sample in the specific-gravity bottle (20° C.) (ml)

0.9982: density of water at 20° C. (g/cm$^3$).

(Examples 1 to 9 and Comparative Examples 1 to 10)

Preparation of Titanium Compound A 100 parts of $TiO(OH)_2$ produced in the above-mentioned method and 40 parts of isobutyl trimethoxy silane were mixed, and the mixture was reacted by heating. Then the resultant product was washed with water, filtrated, and dried at 120° C. Soft aggregations thereof were loosened with a pin mill so as to obtain titanium compound A having an average particle size of 25 nm and a specific gravity of 3.1.

Preparation of Titanium Compound B

In a process the same as for titanium compound A except that the pH adjustment and the dispersion adjustment for adjusting the particle size were hanged, titanium compound B having an average particle size of 50 nm and a specific gravity of 3.1 was obtained.

Preparation of Titanium Compound C

In a process the same as for titanium compound A except that the amount of isobutyl trimethoxy silane was changed to 20 parts, titanium compound C having an average particle size of 25 nm and a specific gravity of 3.4 was obtained.

Preparation of Titanium Compound D

In a process the same as for titanium compound A except that isobutyl trimethoxy silane was replaced by decyl trimethoxy silane, titanium compound D having an average particle size of 25 nm and a specific gravity of 3.4 was obtained.

Preparation of Titanium Compound E

In a process the same as for titanium compound B except that isobutyl trimethoxy silane was replaced by diphenyl dimethoxy silane and the amount was changed to 60 parts, titanium compound E having an average particle size of 50 nm and a specific gravity of 3.6 was obtained.

Preparation of Titania Particle A $TiO(OH)_2$ prepared by the above-mentioned method was washed with water, filtrated, and baked to obtain titanium oxide having an average particle size of 25 nm. Then the obtained titanium oxide was pulverized with a jet mill to obtain titania particle A (specific gravity 4.0).

Preparation of Titania Particle B 100 parts of titania particle A were dispersed in methanol. 40 parts of decyl trimethoxy silane were added to the dispersion. Then the titania particles in the mixture were wet-pulverized with a sand grinder. The solvent was eliminated while stirring the mixture in a kneader. The obtained particles were dried to obtain titania particle B (specific gravity 3.9).

Preparation of Titania Particle C $TiO(OH)_2$ prepared by the above-mentioned method was washed with water, filtrated, and baked to obtain titanium oxide having an average particle size of 25 nm. Then 100 parts of the obtained titanium oxide were dispersed in water and the titanium oxide in the dispersion was wet-pulverized with a sand grinder. 40 parts of isobutyl trimethoxy silane was added to the dispersion and the mixture was stirred and heated to dry the titania particles. The obtained titania particles were pulverized with a jet mill to obtain titania particle C (specific gravity 3.9).

Preparation of Titania Particle D

In a process the same as for titania particle C except that the amount of isobutyl trimethoxy silane was changed to 10 parts, titania particle D having an average particle size of 25 nm and a specific gravity of 3.8 was obtained.

| Preparation of toner particle V | |
|---|---|
| Binder resin (polyester resin Mw = 17,000, Tg = 66° C.) | 95 parts |
| Phthalocyanine pigment (C. I. Pigment Blue 15:3) | 5 parts |

After the above-mentioned materials were mixed with a Henschel mixer, the mixture was melted and kneaded with a Banbary mixer. After cooling, the composition was pulverized finely with a jet mill, and classified with a classifier to obtain toner particle V having an average particle size of 8 μm. The charge amount of obtained toner particle V was −8 μc/g.

| Preparation of toner particle W | |
|---|---|
| Binder resin (polyester resin Mw = 25,000, Tg = 68° C.) | 91 parts |
| Carbon black (BP1300: produced by Cabott Corp.) | 7 parts |
| Charge control agent (BONTRON E88, produced by Orient Chemical Industry, Corp.) | 2 parts |

After the above-mentioned materials were mixed with a Henschel mixer, the mixture was melted and kneaded with a Banbary mixer. After cooling, the composition was pulverized finely with a jet mill, and classified with a classifier to obtain toner particle W having an average particle size of 9.5 μm. The charge amount of obtained toner particle W was −13 μc/g.

| Preparation of toner particle X | |
|---|---|
| Binder resin (styrene-acrylic acid copolymer) (Copolymerization ratio: 80/20, weight-average molecular weight: 105,000, Tg = 65° C.) | 89 parts |
| Yellow pigment (C. I. Pigment Yellow 97) | 5 parts |
| Low molecular weight polypropylene (Biscol 660P: produced by Sanyo Chemical Industries, Ltd.) | 4 parts |
| Low molecular weight polyethylene (molecular weight: 6,000) | 2 parts |

After the above-mentioned materials were mixed with a Henschel mixer, the mixture was melted and kneaded with a continuous kneader produced by Toshiba Machine Co., Ltd. (TEM35). After cooling, the composition was pulverized finely with an I-type mill, and classified with an inertia-type classifier to obtain toner particle X having an average particle size of 7 μm. The charge amount of obtained toner particle X was −10 μc/g.

Example 1

100 parts of toner particle V and 1.0 part of titanium compound A were mixed with a Henschel mixer. The resultant mixture was sifted with an air sieve device having a sieve of 106 μm to obtain a developer 1. The charge amount of the obtained developer 1 was −36 μc/g.

Example 2

In a process the same as for example 1 except that titanium compound A was replaced by titanium compound B, a developer 2 was obtained. The charge amount of the obtained developer 2 was −28 μc/g.

Example 3

In a process the same as for example 1 except that titanium compound A was replaced by titanium compound C, a developer 3 was obtained. The charge amount of the obtained developer 3 was −24 μc/g.

Example 4

In a process the same as for example 1 except that titanium compound A was replaced by titanium compound D, a developer 4 was obtained. The charge amount of the obtained developer 4 was −33 μc/g.

Example 5

In a process the same as for example 2 except that toner particle V were replaced by toner particle W, a developer 5 was obtained. The charge amount of the obtained developer 5 was −35 μc/g.

Example 6

In a process the same as for example 5 except that titanium compound B was replaced by titanium compound E, a developer 6 was obtained. The charge amount of the obtained developer 6 was −29 μc/g.

Example 7

In a process the same as for example 3 except that toner particle V were replaced by toner particle X, a developer 7 was obtained. The charge amount of the obtained developer 7 was −25 μc/g.

Example 8

In a process the same as for example 7 except that titanium compound C was replaced by titanium compound D, a developer 8 was obtained. The charge amount of the obtained developer 8 was −31 μc/g.

Example 9

In a process the same as for example 8 except that the amount of the titanium compound was changed to be 0.5 parts by weight, a developer 9 was obtained. The charge amount of the obtained developer 9 was −27 μc/g.

Comparative Example 1

In a process the same as for example 1 except that titanium compound A was replaced by titania particle A, a developer 10 was obtained. The charge amount of the obtained developer 10 was −6 μc/g.

Comparative Example 2

In a process the same as for example 1 except that titanium compound A was replaced by titania particle C, a developer 11 was obtained. The charge amount of the obtained developer 11 was −20 μc/g.

Comparative Example 3

In a process the same as for example 1 except that titanium compound A was replaced by titania particle D, a developer 12 was obtained. The charge amount of the obtained developer 12 was −18 μc/g.

Comparative Example 4

In a process the same as for example 1 except that titanium compound A was replaced by an amorphous titanium having a particle size of 30 nm, a developer 13 was obtained. The charge amount of the obtained developer 13 was −5 μc/g.

Comparative Example 5

In a process the same as for example 5 except that titanium compound B was replaced by titania particle B, a developer 14 was obtained. The charge amount of the obtained developer 14 was −21 μc/g.

Comparative Example 6

In a process the same as for example 5 except that titanium compound B was replaced by titania particle C, a developer 15 was obtained. The charge amount of the obtained developer 15 was −19 μc/g.

Comparative Example 7

In a process the same as for example 5 except that titanium compound B was replaced by fine silica particles having a particle size of 12 nm treated with hexamethyldisilazane, a developer 16 was obtained. The charge amount of the obtained developer 16 was −25 μc/g.

Comparative Example 8

In a process the same as for example 7 except that titanium compound B was replaced by titania particle C, a developer 17 was obtained. The charge amount of the obtained developer 17 was −17 μc/g.

Comparative Example 9

In a process the same as for example 7 except that titanium compound C was replaced by fine silica particles having a particle size of 16 nm treated with a silicone oil, a developer 18 was obtained. The charge amount of the obtained developer 18 was −22 μc/g.

Comparative Example 10

In a process the same as for example 7 except that titanium compound C was replaced by hydrophilic fine silica particle having a particle size of 16 nm, a developer 19 was obtained. The charge amount of the obtained developer 19 was −15 μc/g.

For the evaluation of the charge property and the image quality of the developers 1 to 19, an image forming device shown in FIG. 1 was used. A latent image retainer 1 and a developer holder 3 in FIG. 1 were arranged so as to have a constant gap therebetween. After being charged with a roller charger 2 to −400 V, the latent image retainer 1 was exposed to a laser beam to form a latent images. An alternating current of a frequency of 2.0 kHz and Vpp of 1.5 kV and a direct current of −300 V were applied to the developer holder 3 and roller 4, an to the latent image retainer 1 respectively for developing the latent images. An elastic blade 5 made from silicone rubber was contacted to the developer holder 3 with a constant linear load for forming a thin layer of a toner. Furthermore, the peripheral speed of the latent image retainer 1 was set to be 60 mm/s, and a peripheral speed of the developing holder 3 was set to be 90 mm/s. A roller transfer device 6 was used for the transfer of the toner, and a blade-type cleaner 7 was used for cleaning. Alumite was used as the material of the developer holder 3.

With the image forming device in FIG. 1, a 10, 000-sheet printing test of the obtained developers 1 to 19 was conducted under a high-temperature and high-humidity condition of 28° C. and 85% RH and under a low-temperature and low-humidity condition of 10° C. and 30% RH. Results are shown in Table 1.

Characteristics in Table 1 were evaluated as follows:

[Toner flow characteristic (*3)]

The dispensed amount was measured with an offline auger dispenser. ○ denotes a dispensed amount of 700 mg/s or more, and X denotes a dispensed amount of less than 700 mg/s.

[Initial charge amount and charge amount after printing 10,000 sheets (*4)]

A toner was transported on the developer holder and left t for 24 hours under each condition. The charge amount under each condition was measured with a suction Toribo measurement method. The charge amount after printing10, 000 sheets was measured in the same process.

[Comprehensive evaluation on charging (*5)]

Charge stability A

A number calculated by the formula [(initial charge amount at high temperature and high humidity)÷(initial charge amount at low temperature and low humidity)+(charge amount after printing 10,000 sheets at high temperature and high humidity)÷(charge amount after printing 10,000 sheets at low temperature and low humidity)] was evaluated with the criteria set forth below.

○ 0.7 or more

Δ 0.5 or more but less than 0.7

X less than 0.5

Charge stability B

A number calculated by the formula [(charge amount after printing 10,000 sheets at high temperature and high humidity)÷(initial charge amount at high temperature and high humidity)+(charge amount after printing 10,000 sheets at low temperature and low humidity)÷(initial charge amount at low temperature and low humidity)] was evaluated with the criteria set forth below.

○0.8 or more

Δ 0.5 or more but less than 0.8

X 0.3 or more but less than 0.5

X X less then 0.3

Charge distribution

The charge distribution of a toner on the developer holder after printing 10,000 sheets under each condition was measured with a charge distribution measuring apparatus. An average of a number found by dividing the central number of distribution by the width of distribution under a high-temperature and high-humidity condition and a number found by the same procedure under a low-temperature and low-humidity condition was calculated and evaluated with the criteria set forth below.

○ 0.6 or more

Δ 0.4 or more but less than 0.6

X 0.2 or more but less than 0.4

X X less than 0.2

[Comprehensive evaluation on image quality (*7)]

Fogging in the background (BKG)

The optical densities of the image and the background portion of a 10,000th copy were measured with a densitometer, X-RITE404A, produced by X-RITE Corp. The absolute value of the optical densities of the image and the background portion was found, and the average of the absolute values under both conditions was found. The average was evaluated with the criteria set forth below.

○ 0 0.015 or less

Δ more than 0.015 but 0.03 or less

X more than 0.03 but less than 0.10 or less

X X more than 0.10

Stripes on the developer holder

Under each condition, a solid image was copied on an A4-size sheet of paper. Optical densities of three portions of the solid image (vicinity of one end including a shorter side, central portion, vicinity of the other end including the other shorter side) were measured with a Macbeth densitometer. An average of the measured values under the high-temperature and high-humidity condition and under the low-temperature and low-humidity condition was evaluated with the criteria set forth below; the comprehensive evaluations under both conditions are shown in Table 1.

○ No stripe-like unevenness on the developer holder and with a density difference in the measured three portions of 0.2 or less Δ With stripe-like unevenness on the developer holder but with the above-mentioned density difference of 0.2 or less X With stripe-like unevenness on the developer holder and with the above-mentioned density difference of more than 0.2

Density retention property

The optical density of the image of a 10,000th copy was measured with a densitometer, X-RITE404A, produced by X-RITE Corp. The average of the optical densities under both conditions was calculated. The average value was evaluated with the criteria set forth below.

○ 1.3 or more

Δ less than 1.3 but 1.1 or more

X less than 1.1

Filming

Image defect caused by the damage to the latent image retainer were evaluated by visual inspection with the criteria set forth below. The comprehensive evaluations under both conditions are shown in Table 1.

○ No damage to the latent image retainer

Δ Damage to the latent image retainer but without density unevenness of the image X Damage to the latent image retainer and with density unevenness of the image Toner scattering Whether or not the toner scattered on the latent image retainer was evaluated by visual inspection with the criteria set forth below. The comprehensive evaluations under both conditions are shown in Table 1.

○ No dirt on the paper and no dirt in the developing device

Δ No dirt on the paper but with dirt in the developing device

X With dirt on the back of the paper and with dirt in the developing device

X X With dirt on both sides of the paper and with dirt in the developing device

TABLE 1

| | | Initial charge amount*4 (μc/g) | | Charge amount after printing 10,000 sheets (μc/g) | | Comprehensive evaluation on charging | | |
|---|---|---|---|---|---|---|---|---|
| | Toner flow characteristic*3 (mg/s) | High temperature and high humidity | Low temperature and low humidity | High temperature and high humidity | Low temperature and low humidity | Charge stability A | Charge stability B | Charge distribution (10,000) |
| Ex. 1 | 970 (○) | −17 | −21 | −15 | −19 | ○ | ○ | ○ |
| Ex. 2 | 880 (○) | −14 | −16 | −12 | −15 | ○ | ○ | ○ |
| Ex. 3 | 1010 (○) | −12 | −17 | −13 | −15 | ○ | ○ | ○ |
| Ex. 4 | 950 (○) | −18 | −20 | −16 | −22 | ○ | ○ | ○ |
| Ex. 5 | 850 (○) | −16 | −19 | −17 | −20 | ○ | ○ | ○ |
| Ex. 6 | 770 (○) | −15 | −16 | −10 | −14 | ○ | Δ | Δ |
| Ex. 7 | 820 (○) | −15 | −17 | −12 | −15 | ○ | ○ | ○ |
| Ex. 8 | 790 (○) | −18 | −20 | −15 | −19 | ○ | ○ | ○ |
| Ex. 9 | 720 (○) | −13 | −16 | −11 | −16 | ○ | ○ | ○ |
| Comp. Ex. 1 | 630 (X) | −1 | −3 | −4 | −2 | X | Δ | X X |
| Comp. Ex. 2 | 600 (X) | −10 | −18 | −8 | −15 | Δ | ○ | X |
| Comp. Ex. 3 | 670 (X) | −9 | −16 | −9 | −10 | Δ | ○ | Δ |
| Comp. Ex. 4 | 570 (X) | −3 | +1 | −1 | −1 | X | X | X X |
| Comp. Ex. 5 | 610 (X) | −11 | −17 | −10 | −12 | Δ | Δ | X |
| Comp. Ex. 6 | 630 (X) | −12 | −19 | −8 | −16 | Δ | Δ | X |
| Comp. Ex. 7 | 990 (○) | −9 | −36 | −6 | −20 | X | Δ | X X |
| Comp. Ex. 8 | 550 (X) | −9 | −15 | −7 | −16 | Δ | ○ | X |
| Comp. Ex. 9 | 930 (○) | −10 | −34 | −5 | −30 | X | Δ | X X |
| Comp. Ex. 10 | 1010 (○) | −6 | −22 | −1 | −15 | X | X | X X |

TABLE 1-continued

| | Comprehensive evaluation on image quality | | | | |
|---|---|---|---|---|---|
| | BKG | Stripes on developer holder | Density retention property | Filming | Toner scattering |
| Ex. 1 | ○ | ○ | ○ | ○ | ○ |
| Ex. 2 | ○ | ○ | ○ | ○ | ○ |
| Ex. 3 | ○ | ○ | ○ | ○ | ○ |
| Ex. 4 | ○ | ○ | ○ | ○ | ○ |
| Ex. 5 | ○ | ○ | ○ | ○ | ○ |
| Ex. 6 | ○ | Δ | ○ | ○ | Δ |
| Ex. 7 | ○ | ○ | ○ | ○ | ○ |
| Ex. 8 | ○ | ○ | ○ | ○ | ○ |
| Ex. 9 | ○ | Δ | ○ | ○ | ○ |
| Comp. Ex. 1 | X X | X | X | Δ | X X |
| Comp. Ex. 2 | X | X | Δ | Δ | X |
| Comp. Ex. 3 | Δ | Δ | ○ | ○ | ○ |
| Comp. Ex. 4 | X | X | X | ○ | X X |
| Comp. Ex. 5 | X | Δ | ○ | X | X |
| Comp. Ex. 6 | Δ | Δ | Δ | X | Δ |
| Comp. Ex. 7 | Δ | ○ | ○ | Δ | Δ |
| Comp. Ex. 8 | X | X | ○ | X | Δ |
| Comp. Ex. 9 | Δ | ○ | X | ○ | ○ |
| Comp. Ex. 10 | Δ | Δ | X | ○ | X X |

(Examples 10 to 16 and Comparative Examples 11 to 18)

Preparation of Titanium Compound F 100 parts of $TiO(OH)_2$ produced in the above-mentioned method and 50 parts of isobutyl trimethoxy silane were mixed, and the mixture was reacted by heating. Then the resultant product was washed with water, filtrated, and dried at 120° C. Soft aggregations thereof were loosened with a pin mill so as to obtain titanium compound F having an average particle size of 35 nm and a specific gravity of 3.1.

Preparation of Titanium Compound G

In a process the same as for titanium compound F except that the pH adjustment and the dispersion adjustment for adjusting the particle size were changed, titanium compound G having an average particle size of 20 nm and a specific gravity of 3.2 was obtained.

Preparation of Titanium Compound H

In a process the same as for titanium compound F except that the amount of isobutyl trimethoxy silane was changed to 20 parts, titanium compound H having an average particle size of 35 nm and a specific gravity of 3.4 was obtained.

Preparation of Titanium Compound I

In a process the same as for titanium compound F except that isobutyl trimethoxy silane was replaced by decyl trimethoxy silane, titanium compound I having an average particle size of 35 nm and a specific gravity of 3.3 was obtained.

Preparation of Titanium Compound J

In a process the same as for titanium compound G except that isobutyl trimethoxy silane was replaced by diphenyl dimethoxy silane and the amount of the silane compound was changed to 65 parts, a titanium compound J having an average particle size of 20 nm and a specific gravity of 3.0 was obtained.

Preparation of Titania Particle E $TiO(OH)_2$ prepared by the above-mentioned method was washed with water, filtrated, and baked to obtain titanium oxide having an average particle size of 35 nm. Then the obtained titanium oxide was pulverized with a jet mill to obtain titania particle E (specific gravity 4.0).

Preparation of Titania Particle F 100 parts of titania particle E were dispersed in methanol. 40 parts of decyl trimethoxy silane was added to the dispersion. Then titania particles in the mixture were wet-pulverized with a sand grinder. The solvent was eliminated while stirring the mixture in a kneader. The obtained particles were dried to obtain titania particle F (specific gravity 3.9).

Preparation of Titania Particle G $TiO(OH)_2$ prepared by the above-mentioned method was washed with water, filtrated, and baked to obtain titanium oxide having an average particle size of 35 nm. Then 100 parts of the obtained titanium oxide were dispersed in water and the titanium oxide in the dispersion was wet-pulverized with a sand grinder. 40 parts of isobutyl trimethoxy silane were added to the dispersion and the mixture was stirred and heated to dry the titania particles. The obtained titania particles were pulverized with a jet mill to obtain titania particle G (specific gravity 3.9).

Preparation of Titania Particle H

In a process the same as for titania particle G except that the amount of the silane compound was changed to 10 parts, titania particle H having an average particle size of 35 nm and a specific gravity of 3.9 were obtained.

| Preparation of toner particle Y | |
|---|---|
| Binder resin (polyester resin Mw = 17,000, Tg = 66° C.) | 50 parts |
| Magnetite (hexahedron, particle size: 0.15 μm) | 50 parts |
| Low molecular weight polypropylene (Biscol 660P: produced by Sanyo Chemical Industries, Ltd.) | 4 parts |

After the above-mentioned materials were mixed with a Henschel mixer, the mixture was melted and kneaded with a continuous kneader produced by Toshiba Machine Co., Ltd. (Extruder TEM50) with a set temperature of 140° C., a screw rotation frequency of 300 rpm, and a supply rate of 100 kg/h. After cooling, the obtained composition was pulverized finely with a jet mill, and classified with a classifier to obtain toner particle Y having an average particle size of 8 μm.

| Preparation of toner particle Z | |
|---|---|
| Binder resin (styrene-acrylic acid copolymer) (Copolymerization ratio: 80/20, weight-average molecular weight: 105,000, Tg = 65° C.) | 44 parts |
| Magnetite (hexahedron, particle size: 0.10 μm) | 50 parts |
| Charge control agent (BONTRON E84, produced by Orient Chemical Industry, Corp.) | 2 parts |
| Low molecular weight polypropylene (Biscol 660P: produced by Sanyo Chemical Industries, Ltd.) | 4 parts |

After the above-mentioned materials were mixed with a Henschel mixer, the mixture was melted and kneaded with a continuous kneader produced by Toshiba Machine Co., Ltd. (Extruder TEM50) with a set temperature of 140° C., a screw rotation frequency of 300 rpm, and a supply rate of 100 kg/h. The obtained composition was pulverized finely with a jetmill (400AFG+coarsepowder classifier 200ATP: produced by Hosokawa Micron Corp.), and the pulverized product was classified with an air classifier (TC40: produced by Nisshin Engineering Corp.) to obtain toner particles Z having an average particle size of 7 μm.

Example 10

100 parts of toner particle Y and 1.0 part of titanium compound F were mixed with a Henschel mixer. The resultant mixture was sifted with an air sieve device having a sieve of 106 μm to obtain a developer 20. The charge amount of the obtained developer 20 was −35 μc/g.

Example 11

In a process the same as for example 10 except that titanium compound F was replaced by titanium compound G, a developer 21 was obtained. The charge amount of the obtained developer 21 was −38 μc/g.

Example 12

In a process the same as for example 10 except that titanium compound F was replaced by titanium compound H, a developer 22 was obtained. The charge amount of the obtained developer 22 was −32 μc/g.

Example 13

In a process the same as for example 10 except that titanium compound F was replaced by titanium compound I, a developer 23 was obtained. The charge amount of the obtained developer 23 was −41 μc/g.

Example 14

In a process the same as for example 11 except that toner particle Y was replaced by toner particle Z, a developer 24 was obtained. The charge amount of the obtained developer 24 was −58 μc/g.

Example 15

In a process the same as for example 14 except that titanium compound G was replaced by titanium compound J, a developer 25 was obtained. The charge amount of the obtained developer 25 was −49 μc/g.

Example 16

In a process the same as for example 14 except that the amount of the titanium compound was changed to be 0.5 parts by weight, a developer 26 was obtained. The charge amount of the obtained developer 26 was −47 μc/g.

Comparative Example 11

In a process the same as for example 10 except that titanium compound F was replaced by titania particle G, a developer 27 was obtained. The charge amount of the obtained developer 27 was −23 μc/g.

Comparative Example 12

In a process the same as for example 10 except that titanium compound F was replaced by titania particle F, a developer 28 was obtained. The charge amount of the obtained developer 28 was −30 μc/g.

Comparative Example 13

In a process the same as for example 10 except that titanium compound F was replaced by titania particle H, a developer 29 was obtained. The charge amount of the obtained developer 29 was −27 μc/g.

Comparative Example 14

In a process the same as for example 10 except that titanium compound F was replaced by an amorphous titanium having a particle size of 30 nm, a developer 30 was obtained. The charge amount of the obtained developer 30 was −9 μc/g.

Comparative Example 15

In a process the same as for example 14 except that titanium compound G was replaced by titania particle F, a developer 31 was obtained. The charge amount of the obtained developer 31 was −27 μc/g.

Comparative Example 16

In a process the same as for example 14 except that titanium compound G was replaced by titania particle G, a developer 32 was obtained. The charge amount of the obtained developer 32 was −23 μc/g.

Comparative Example 17

In a process the same as for example 14 except that titanium compound G was replaced by fine silica particles having a particle size of 12 nm treated with hexamethyldisilazane, a developer 33 was obtained. The charge amount of the obtained developer 33 was −45 μc/g.

Comparative Example 18

In a process the same as for example 14 except that titanium compound G was replaced by 0.5 part of fine silica particles having a particle size of 16 nm treated with a silicone oil and 0.5 part of titania particle G, a developer 34 was obtained. The charge amount of the obtained developer 34 was −36 μc/g.

For the evaluation of the charge property and the image quality of the developers 20 to 34, the image forming device shown in FIG. 1 was used. As a latent image retainer 1, a cylindrical organic photoreceptor with an outer diameter of 15 mm which had a SUS support was used. As a developer holder 3, an aluminum developing roller with an outer diameter of 10 mm having a built-in magnet of 700 G was used. An elastic blade 5 made from silicone rubber was contacted to the developer holder 3 with a constant linear load of 330 g/cm for forming a thin layer of toner. The latent image retainer 1 and the developer holder 3 were arranged so as to have a gap of 250 μm therebetween. After being charged with a roller charger 2 to −350 V, the latent image retainer 1 was exposed to a laser beam to form latent images. An alternative current of a frequency of 2.1 kHz and Vpp of 2.2 kV and a direct current of −250 V were applied to the developer holder 3 for developing the latent image. Furthermore, the peripheral speed of the latent image retainer 1 was set to be 60 mm/s, and the peripheral speed of the developer holder 3 was set to be 72 mm/s. A roller transfer device 6 was used for the transfer of the toner, and a blade-type cleaner 7 was used for cleaning.

With the image forming device in FIG. 1, a 10,000-sheet printing test of the obtained developers 20 to 34 was conducted under a high-temperature and high-humidity condition of 28° C. and 85% RH and under a low-temperature and low-humidity condition of 10° C. and 30% RH. Results are shown in Table 2.

In the evaluation of toner flow characteristic (*3) in Table 2, ○ denotes a dispensed amount of 1,000 mg/s or more.

TABLE 2

| | | Initial charge amount*4 (μc/g) | | Charge amount after printing 10,000 sheets (μc/g) | | Comprehensive evaluation on charging | | |
|---|---|---|---|---|---|---|---|---|
| | Toner flow characteristic*3 (mg/s) | High temperature and high humidity | Low temperature and low humidity | High temperature and high humidity | Low temperature and low humidity | Charge stability A | Charge stability B | Charge distribution (10,000) |
| Ex. 10 | 1150 (○) | −12 | −14 | −11 | −13 | ○ | ○ | ○ |
| Ex. 11 | 1280 (○) | −11 | −15 | −9 | −12 | ○ | ○ | ○ |
| Ex. 12 | 1310 (○) | −9 | −12 | −7 | −11 | ○ | ○ | ○ |
| Ex. 13 | 1260 (○) | −12 | −15 | −11 | −14 | ○ | ○ | ○ |
| Ex. 14 | 1140 (○) | −12 | −15 | −12 | −13 | ○ | ○ | ○ |
| Ex. 15 | 1090 (○) | −11 | −14 | −8 | −10 | ○ | ○ | Δ |
| Ex. 16 | 1220 (○) | −10 | −12 | −9 | −12 | ○ | ○ | ○ |
| Comp. Ex. 11 | 910 (X) | −1 | −2 | +4 | −2 | X | X X | X X |
| Comp. Ex. 12 | 890 (X) | −6 | −9 | −5 | −10 | Δ | Δ | X |
| Comp. Ex. 13 | 930 (X) | −5 | −8 | +1 | −6 | Δ | X | Δ |
| Comp. Ex. 14 | 870 (X) | −3 | +1 | −1 | −1 | X | X | X X |
| Comp. Ex. 15 | 880 (X) | −6 | −10 | −3 | −6 | Δ | Δ | X |
| Comp. Ex. 16 | 970 (X) | −6 | −10 | −4 | −6 | Δ | Δ | X |
| Comp. Ex. 17 | 1290 (○) | −4 | −12 | −1 | −10 | X | Δ | X |
| Comp. Ex. 18 | 1050 (○) | −5 | −8 | −4 | −6 | Δ | ○ | Δ |

| | Comprehensive evaluation on image quality | | | | |
|---|---|---|---|---|---|
| | BKG | Stripes on developer holder | Density retention property | Filming | Toner scattering |
| Ex. 10 | ○ | ○ | ○ | ○ | ○ |
| Ex. 11 | ○ | ○ | ○ | ○ | ○ |
| Ex. 12 | ○ | ○ | ○ | ○ | ○ |
| Ex. 13 | ○ | ○ | ○ | ○ | ○ |
| Ex. 14 | ○ | ○ | ○ | ○ | ○ |
| Ex. 15 | ○ | Δ | ○ | ○ | Δ |
| Ex. 16 | ○ | ○ | ○ | ○ | ○ |
| Comp. Ex. 11 | X X | X | X | Δ | X X |
| Comp. Ex. 12 | X | X | Δ | Δ | X |

TABLE 2-continued

| | | | | | |
|---|---|---|---|---|---|
| Comp. Ex. 13 | X | Δ | ○ | X | X |
| Comp. Ex. 14 | X | X | X | ○ | X X |
| Comp. Ex. 15 | X | Δ | ○ | X | Δ |
| Comp. Ex. 16 | Δ | Δ | Δ | X | Δ |
| Comp. Ex. 17 | Δ | ○ | ○ | X | X |
| Comp. Ex. 18 | X | X | ○ | X | ○ |

(Examples 17 to 21 and Comparative Examples 19 to 22)

Preparation of Titanium Compound K 100 parts of $TiO(OH)_2$ produced in the above-mentioned method and 40 parts of isobutyl trimethoxy silane were mixed, and the mixture was reacted by heating. Then the obtained product was washed with water, filtrated, and dried at 120° C. Soft aggregations thereof were loosened with a pin mill so as to obtain titanium compound K having an average particle size of 50 nm and a resistance of $5.9\times10^9\Omega\cdot$cm.

Preparation of Titanium Compound L

In a process the same as for titanium compound K except that the pH adjustment and the dispersion adjustment for adjusting the particle size were changed, and that the amount of isobutyl trimethoxy silane was changed to 50 parts, titanium compound L having an average particle size of 30 nm and a resistance of $3.6\times10^8\Omega\cdot$cm was obtained.

Preparative of Titanium Compound M

In a process the same as for titanium compound K except that isobutyl trimethoxy silane was replaced by 40 parts of tetramethoxy silane, titanium compound M having an average particle size of 50 nm and a resistance of $4.2\times10^9\Omega\cdot$cm was obtained.

Preparative of Titanium Compound N

In a process the same as for titanium compound L except that isobutyl trimethoxy silane was replaced by 50 parts of diphenyl dichloro silane, titanium compound N having an average particle size of 30 nm and a resistance of $8.4\times10^{10}\Omega\cdot$cm was obtained.

Preparation of Titanium compound O

In a process the same as for titanium compound K except that isobutyl trimethoxy silane was replaced by 40 parts of decyl trimethoxy silane, titanium compound o having an average particle size of 50 nm and a resistance of $2.4\times10^{10}\Omega\cdot$cm was obtained.

Preparation of Titania Particle I $TiO(OH)_2$ prepared by the above-mentioned method was washed with water, filtrated, and baked to obtain titanium oxide having an average particle size of 50 nm and a resistance of $4.3\times10^6\Omega\cdot$cm was obtained. Then the obtained titanium oxide was pulverized with a jet mill to obtain titania particle I.

Preparation of Titania Particle J 100 parts of titania particle I were dispersed in methanol. 40 parts of isobutyl trimethoxy silane were added to the dispersion. Then the titania particles in the mixture were wet-pulverized with a sand grinder. The solvent was eliminated while stirring the mixture in a kneader. The obtained particles were dried to obtain titania particle J having a resistance of $5.4\times10^8\Omega\cdot$cm.

Preparation of Titania Particle K $TiO(OH)_2$ prepared by the above-mentioned method was washed with water, filtrated, and baked to obtain titanium oxide having an average particle size of 30 nm. Then 100 parts of the obtained titanium oxide was dispersed in water and the titanium oxide in the dispersion was wet-pulverized with a sand grinder. 50 parts of isobutyl trimethoxy silane were added to the dispersion and the mixture was stirred and heated to dry the titania particles. The obtained particles were pulverized with a jet mill to obtain titania particle K having a resistance of $3.4\times10^8\Omega\cdot$cm.

Preparation of Silica Particles A 20 parts of dimethyl silicone oil were dissolved in 300 parts of ethanol, and the resultant solution was mixed with 100 parts of fine silica particles having an average primary particle size of 12 nm. Then ethanol was eliminated from the mixture with an evaporator. After drying, the fine silica particles were pulverized using a mortar and sifted with a sieve of 105 $\mu$m to obtain silica particle A treated with silicone oil having a BET specific surface area of 120 $m^2/g$.

Preparation of Silica Particle B 10 parts of dimethyl silicone oil were dissolved in 300 parts of ethanol, and the resultant solution was mixed with 100 parts of fine silica particles having an average primary particle size of 60 nm. Then ethanol was eliminated from the mixture with an evaporator. After drying, the fine silica particles were pulverized using a mortar and sifted with a sieve of 105 $\mu$m to obtain silica particle B treated with silicone oil having a BET specific surface area of 50 $m^2/g$.

Then toner particles were produced. The particle size of the toner was measured with a particle size measuring apparatus, TA-II (aperture diameter 100 $\mu$m) produced by Colter Counter Corp.

| Preparation of magnetic toner particle 1 | |
|---|---|
| Binder resin: styrene-butyl acrylate copolymer (Mw = 150,000, copolymer ratio 80:20, Tg = 62° C.) | 50 parts |
| Magnetic powder: Hexahedron magnetite (average primary particle size: 0.2 $\mu$m) | 47 parts |
| Charge control agent: T-77 (iron-containing metal azo dye, produced by Hodogaya Chemical Co., Ltd.) | 1 part |
| Mold-release agent: polypropylene wax (Biscol 660P: produced by Sanyo Chemical Industries, Ltd.) | 2 parts |

After the above-mentioned materials were mixed with a Henschel mixer, the mixture was melted and kneaded with an extruder. After cooling, the resultant composition was pulverized coarsely, further pulverized finely with a jet mill, and air-classified to obtain magnetic toner particles 1 having a volume average particle size D50 of 8.8 $\mu$m.

| Preparation of nonmagnetic toner particle 2 | |
|---|---|
| Binder resin: polyester resin (Condensated polymer of terephthalic acid-adduct that ethylene oxide is added to bisphenol A, Mw = 25000, Tg = 68° C.) | 93 parts |
| Charge control agent: T-77 (iron-containing metal azo dye, produced by Hodogaya Chemical Co., Ltd.) | 1 part |
| Colorant: carbon black (BP1300: produced by Cabott Corp.) | 4 parts |
| Mold-release agent: polypropylene wax (Biscol 660P: produced by Sanyo Chemical Industries, Ltd.) | 2 parts |

After the above-mentioned materials were mixed with a Henschel mixer, the mixture was melted and kneaded with an extruder. After cooling, the resultant composition was pulverized finely with a jet mill. The pulverized product was air-classified to obtain nonmagnetic toner particle 2 having a volume average particle size D50 of 9.2 μm.

Example 17

100 parts of the magnetic toner particle 1, 0.5 part of silica particle A, and 1.0 part of titanium compound K were mixed with a Henschel mixer. The obtained mixture was sifted with an air sieve device having a sieve of 106 μm to obtain a developer 35.

Example 18

100 parts of the magnetic toner particle 1, 0.5 part of silica particle A, and 0.8 part of titanium compound L were mixed with a Henschel mixer. The obtained mixture was sifted with an air sieve device having a sieve of 106 μm to obtain a developer 36.

Example 19

100 parts of the magnetic toner particle 1, 0.5 part of silica particle B, and 1.0 part of titanium compound M were mixed with a Henschel mixer. The obtained mixture was sifted with an air sieve device having a sieve of 106 μm to obtain a developer 37.

Example 20

100 parts of the magnetic toner particle 1, 0.5 part of silica particle B, and 0.8 part of titanium compound N were mixed with a Henschel mixer. The obtained mixture was sifted with an air sieve device having a sieve of 106 μm to obtain a developer 38.

Example 21

100 parts of the magnetic toner particle 1, 0.75 part of silica particle A, and 1.0 part of titanium compound O were mixed with a Henschel mixer. The obtained mixture was sifted with an air sieve device having a sieve of 106 μm to obtain a developer 39.

Comparative Example 19

100 parts of the magnetic toner particle 1, 0.5 part of silica particle A, and 1.0 part of titania compound I were mixed with a Henschel mixer. The obtained mixture was sifted with an air sieve device having a sieve of 106 μm to obtain a developer 40.

Comparative Example 20

100 parts of the magnetic toner particle 1, 0.5 part of silica particle A, and 1.0 part of titania compound J were mixed with a Henschel mixer. The obtained mixture was sifted with an air sieve device having a sieve of 106 μm to obtain a developer 41.

Comparative Example 21

100 parts of the magnetic toner particle 1, 0.5 part of silica particle B, and 0.8 part of titania compound K were mixed with a Henschel mixer. The obtained mixture was sifted with an air sieve device having a sieve of 106 μm to obtain a developer 42.

Comparative Example 22

100 parts of the magnetic toner particle 1, 0.5 part of hydrophobic silica R972 (produced by Aerosil Corp.), and 0.8 part of titania compound K were mixed with a Henschel mixer. The obtained mixture was sifted with an air sieve device having a sieve of 106 μm to obtain a developer 43.

Figure 2:
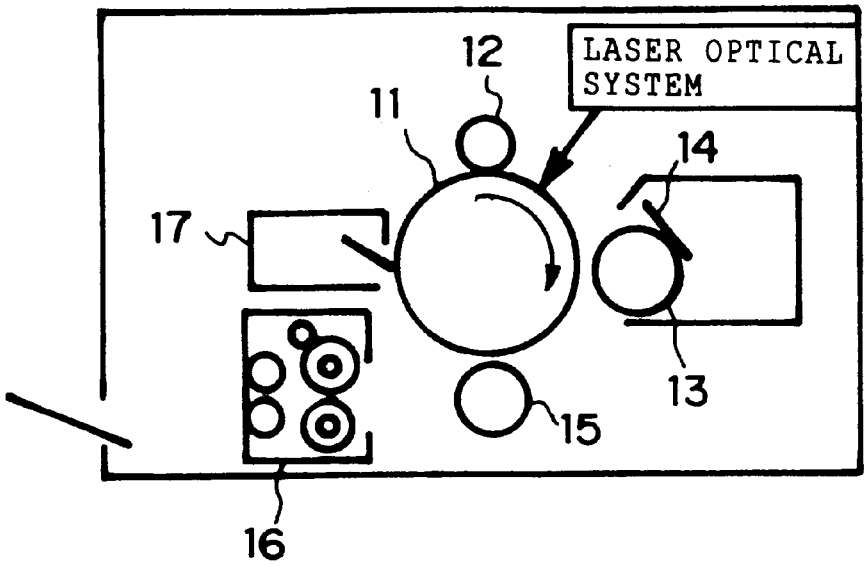
FIG. 2 is a schematic diagram illustrating a preferable embodiment of a magnetic one-component developing device applied with the present invention.

FIG. 2 shows the image forming device which was used for the evaluation of the image quality of the developers (magnetic one-component developers) 35 to 43.

In the image forming device in FIG. 2, after being charged with a roller charger 12, a latent image retainer 11 is exposed to a laser beam to form latent images. A developer holder 13 which is made from aluminum and which has a built-in magnet is arranged closely spaced (noncontact) with the latent image retainer 11. The latent images on the latent image retainer 11 are developed by a thin layer of a developer formed with an elastic blade 14 made from urethane rubber on the developer holder 13. A toner on the latent image retainer 11 is transferred to the transfer paper by a noncontact-type transfer roller 15. The toner on the transfer paper is fixed by a fixing device16by heating. Residual toner on the latent image retainer 11 is cleaned away by a blade-type cleaner 17. The peripheral speed of the latent image retainer 11 was set to be 100 mm/s, and the peripheral speed of the developer holder 13 was set to be 150 mm/s. An alternating current and a direct current were applied to the developer holder 13 for developing the latent image.

With the image forming device in FIG. 2, a 10,000-sheet printing test of the obtained developers 35 to 43 was conducted under a high-temperature and high-humidity condition of 28° C. and 85% RH and under a low-temperature and low-humidity condition of 10° C. and 30% RH. Results are shown in Table 3.

Examples 22 to 26 and Comparative Examples 23 to 27

Example 22

100 parts of the nonmagnetic toner particle 2, 1.3 parts of silica particle A, and 1.0 part of titanium compound K were mixed with a Henschel mixer. The obtained mixture was sifted with an air sieve device having a sieve of 106 μm to obtain a developer 44.

Example 23

100 parts of the nonmagnetic toner particle 2, 1.3 parts of silica particle A, and 0.8 parts of titanium compound L were mixed with a Henschel mixer. The obtained mixture was sifted with an air sieve device having a sieve of 106 μm to obtain a developer 45.

Example 24

100 parts of the nonmagnetic toner particle 2, 1.5 parts of silica particle B, and 1.0 part of titanium compound K were mixed with a Henschel mixer. The obtained mixture was sifted with an air sieve device having a sieve of 106 μm to obtain a developer 46.

Example 25

100 parts of the nonmagnetic toner particle 2, 1.5 parts of silica particle B, and 1.0 part of titanium compound M were mixed with a Henschel mixer. The obtained mixture was sifted with an air sieve device having a sieve of 106 μm to obtain a developer 47.

Example 26

100 parts of the nonmagnetic toner particle 2, 1.3 parts of silica particle A, and 1.0 part of titanium compound O were mixed with a Henschel mixer. The obtained mixture was sifted with an air sieve device having a sieve of 106 μm to obtain a developer 48.

Comparative Example 23

100 parts of the nonmagnetic toner particle 2, 1.3 parts of silica particle A, and 1.0 part of titania compound I were mixed with a Henschel mixer. The obtained mixture was sifted with an air sieve device having a sieve of 106 μm to obtain a developer 49.

Comparative Example 24

100 parts of the nonmagnetic toner particle 2, 1.3 parts of silica particle A, and 1.0 part of titania compound J were mixed with a Henschel mixer. The obtained mixture was sifted with an air sieve device having a sieve of 106 μm to obtain a developer 50.

Comparative Example 25

100 parts of the nonmagnetic toner particle 2, 1.3 parts of silica particle A, and 0.8 part of titania compound K were mixed with a Henschel mixer. The obtained mixture was sifted with an air sieve device having a sieve of 106 μm to obtain a developer 51.

Comparative Example 26

100 parts of the nonmagnetic toner particle 2, 1.3 parts of hydrophobic silica R972 (produced by Aerosil Corp.), and 1.0 part of titania compound J were mixed with a Henschel mixer. The obtained mixture was sifted with an air sieve device having a sieve of 106 μm to obtain a developer 52.

Comparative Example 27

100 parts of the nonmagnetic toner particle 2 and 1.3 parts of silica particle A were mixed with a Henschel mixer. The obtained mixture was sifted with an air sieve device having a sieve of 106 μm to obtain a developer 53.

Figure 3:
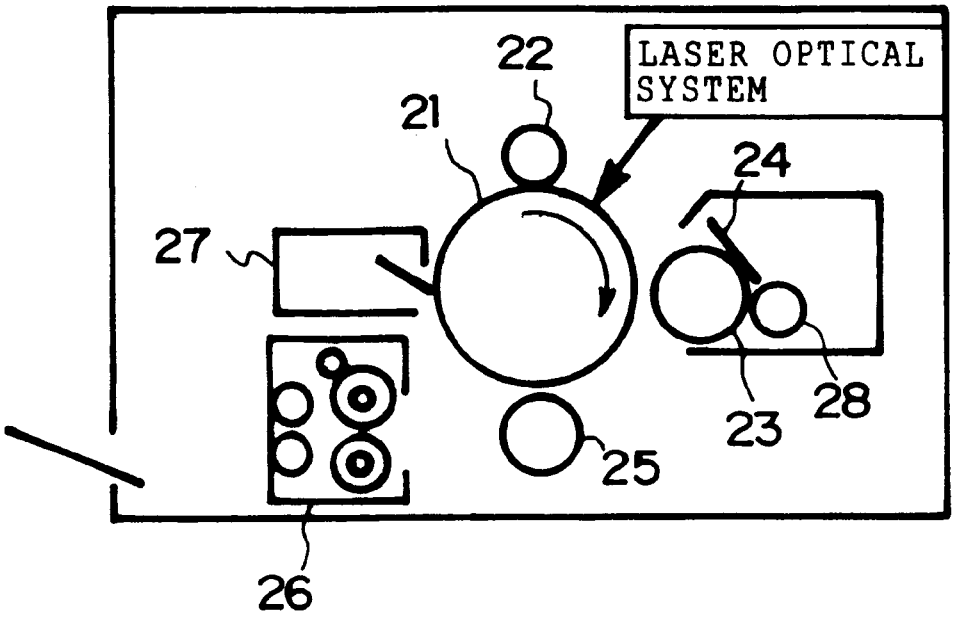
FIG. 3 is a schematic diagram illustrating a preferable embodiment of a nonmagnetic one-component developing device applied with the present invention.

FIG. 3 shows the image forming device which was used for the evaluation of the image quality of developers (nonmagnetic one-component developers) 44 to 53.

In the image forming device in FIG. 3, after being charged with a roller charger 22, a latent image retainer 21 is exposed to a laser beam to form latent images. A developer holder 23 made from aluminum is arranged closely spaced (noncontact) with the latent image retainer 21. The latent image on the latent image retainer 21 is developed by a thin layer of a developer formed with an elastic blade 24 made from urethane rubber on the developer holder 23. A developer supply roller 28, rotating in the opposite direction with respect to. the rotation of the developer holder 23 for stabilizing toner transport, is arranged so as to contact the developer holder 23. Toner on the latent image retainer 21 is transferred to the transfer paper by a contact-type transfer roller 25. The toner on the transfer paper is fixed by a fixing device 26 by heating. Residual toner on the latent image retainer 21 is cleaned off by a blade-type cleaner 27. The peripheral speed of the latent image retainer 21 was set to be 100 mm/s, and the peripheral speed of the developer holder 23 was set to be 170 mm/s. An alternating current and direct current were applied to the developer holder 23 and the developer supply roller 25 for developing the latent image.

With the image forming device in FIG. 3, a 10,000-sheet printing test of the obtained developers 44 to 53 was conducted under a high-temperature and high-humidity condition of 28° C. and 85% RH and under a low-temperature and low-humidity condition of 10° C. and 30% RH. Results are shown in Table 4.

Evaluation methods in Table 3 and Table 4 are as follows:

[Differences of initial charge amounts and charge amounts after printing 10,000 sheets]

A number found by dividing a charge amount in high temperature and high humidity by a charge amount in low temperature and low humidity was evaluated with the criteria set forth below.

○ 0.7 or more

Δ 0.5 or more but less than 0.7

X less than 0.5

[Dropout]

Characters were copied on an OHP transparency, and the obtained characters on the OHP transparency were evaluated with the criteria set forth below. Comprehensive evaluations for both conditions are shown in tables.

○ No dropout

Δ Dropout of less than 1 mm

X Dropout greater than or equal to 1 mm

[Ghosts]

After copying characters, a solid image was copied on a paper. The obtained image was evaluated with the criteria set forth below. Comprehensive evaluations for both conditions are shown in tables.

○ No shade of character appeared on the solid image

Δ No shade of character appeared on the solid image

Other items were evaluated using the same methods as for Table 1.

TABLE 3

| | Toner flow characteristic (mg/s) | Initial charge amount difference (μc/g) | Charge amount difference after printing 10,000 sheets (μc/g) | Fog | Density retention property | Sleeve stripes | Dropout | Toner scattering | Filming | Ghost |
|---|---|---|---|---|---|---|---|---|---|---|
| Ex. 17 | ○ | ○ | ○ | ○ | ○ | ○ | ○ | ○ | ○ | ○ |
| Ex. 18 | ○ | ○ | ○ | ○ | ○ | ○ | ○ | ○ | ○ | ○ |
| Ex. 19 | ○ | ○ | ○ | ○ | Δ | ○ | ○ | ○ | ○ | ○ |
| Ex. 20 | ○ | ○ | ○ | ○ | ○ | ○ | ○ | ○ | ○ | ○ |
| Ex. 21 | ○ | ○ | ○ | ○ | ○ | ○ | ○ | ○ | ○ | ○ |
| Comp. Ex. 19 | X | Δ | Δ | X | X | X | ○ | X | X | ○ |
| Comp. Ex. 20 | X | Δ | Δ | X | X | Δ | ○ | Δ | Δ | ○ |
| Comp. Ex. 21 | ○ | Δ | Δ | X | X | Δ | ○ | Δ | Δ | ○ |
| Comp. Ex. 22 | ○ | Δ | X | X | X | Δ | X | Δ | Δ | ○ |

TABLE 4

| | Toner flow characteristic (mg/s) | Initial charge amount difference (μc/g) | Charge amount difference after printing 10,000 sheets (μc/g) | Fog | Density retention property | Sleeve stripes | Dropout | Toner scattering | Filming | Ghost |
|---|---|---|---|---|---|---|---|---|---|---|
| Ex. 22 | ○ | ○ | ○ | ○ | ○ | ○ | ○ | ○ | ○ | ○ |
| Ex. 23 | ○ | ○ | ○ | ○ | ○ | ○ | ○ | ○ | ○ | ○ |
| Ex. 24 | ○ | ○ | ○ | ○ | ○ | ○ | ○ | ○ | ○ | ○ |
| Ex. 25 | ○ | ○ | ○ | Δ | Δ | ○ | ○ | ○ | ○ | ○ |
| Ex. 26 | ○ | ○ | ○ | ○ | ○ | ○ | ○ | ○ | ○ | ○ |
| Comp. Ex. 23 | X | Δ | Δ | X | X | X | ○ | X | X | ○ |
| Comp. Ex. 24 | X | X | X | X | X | X | ○ | X | Δ | ○ |
| Comp. Ex. 25 | ○ | Δ | X | X | X | X | ○ | X | Δ | ○ |
| Comp. Ex. 26 | X | X | X | X | X | X | X | X | Δ | ○ |
| Comp. Ex. 27 | ○ | X | X | X | X | X | ○ | X | ○ | Δ |

What is claimed is:

1. A one-component developer comprising an external additive, and toner particles containing a binder resin and a colorant, wherein the external additive contains a titanium compound obtained by the reaction of $TiO(OH)_2$ and a silane compound;

wherein said $TiO(OH)_2$ is produced by a wet method; and wherein said titanium compound is obtained by the reaction of 100 parts by weight of $TiO(OH)_2$ and 5 to 80 parts by weight of the silane compound.

2. The one-component developer according to claim 1, wherein the specific gravity of said titanium compound is from 2.8 to 3.6.

3. The one-component developer according to claim 1, wherein said toner particles are nonmagnetic particles.

4. The one-component developer according to claim 3, wherein said external additive further contains silica treated with a silicone oil or a silicone varnish.

5. The one-component developer according to claim 1, wherein said toner particles are magnetic particles.

6. The one-component developer according to claim 5, wherein said external additive further contains silica treated with a silicone oil or a silicone varnish.

7. The one-component developer according to claim 1, wherein said external additive further contains silica treated with a silicone oil or a silicone varnish.

8. The one-component developer according to claim 7, wherein the weight ratio of said titanium compound and said silica treated with said silicone oil or said silicone varnish is 1:0.2 to 1:5.

9. The one-component developer according to claim 7, wherein a BET specific surface area of said silica treated with said silicone oil or said silicone varnish is 20 to 300 $m^2/g$.

10. The one-component developer according to claim 1, wherein the value of the resistivity of said titanium compound is $10^8$ to $10^{12}\Omega\cdot cm$.

* * * * *